US009596927B1

(12) United States Patent
Dasilva

(10) Patent No.: US 9,596,927 B1
(45) Date of Patent: Mar. 21, 2017

(54) ROTATING WIRE BRUSH TOOL

(71) Applicant: Nilson Dasilva, South Yarmouth, MA (US)

(72) Inventor: Nilson Dasilva, South Yarmouth, MA (US)

( * ) Notice: Subject to any disclaimer, the term of this patent is extended or adjusted under 35 U.S.C. 154(b) by 6 days.

(21) Appl. No.: 14/680,164

(22) Filed: Apr. 7, 2015

(51) Int. Cl.

| | |
|---|---|
| ***A47L 13/02*** | (2006.01) |
| ***A46B 13/02*** | (2006.01) |
| ***A46B 13/00*** | (2006.01) |
| ***A46B 17/06*** | (2006.01) |

(52) U.S. Cl.
CPC ..... *A46B 13/02* (2013.01); *A46B 13/001* (2013.01); *A46B 17/06* (2013.01)

(58) Field of Classification Search
CPC ..... A46B 13/02; A46B 13/001; A46B 17/06; A47L 17/00; A47L 13/02
See application file for complete search history.

(56) References Cited

U.S. PATENT DOCUMENTS

| | | | | |
|---|---|---|---|---|
| 3,196,473 | A * | 7/1965 | Bell | A47L 17/00 15/23 |
| 5,307,534 | A | 5/1994 | Miller | |
| 5,353,461 | A * | 10/1994 | Enriquez | A47L 15/0068 15/104.095 |
| 5,636,400 | A | 6/1997 | Young | |
| 5,809,601 | A | 9/1998 | Rivera, Jr. | |
| 6,237,179 | B1 | 5/2001 | Balceiro | |
| 6,817,932 | B2 * | 11/2004 | Furey | A47J 37/0786 15/160 |
| 7,213,289 | B2 | 5/2007 | Jaffe | |
| 7,356,867 | B1 | 4/2008 | Beiermann | |
| D641,555 | S | 7/2011 | Schochet | |
| 8,479,346 | B1 * | 7/2013 | Raghuprasad | A47L 13/34 15/111 |

FOREIGN PATENT DOCUMENTS

| | | |
|---|---|---|
| CN | 2772307 | 4/2006 |

* cited by examiner

*Primary Examiner* — Shay Karls

(57) ABSTRACT

The rotating wire brush tool is an appliance that is used to clean paintbrushes. The paint uses rotating wires to extract paint from a paintbrush.

1 Claim, 6 Drawing Sheets

ROTATING WIRE BRUSH TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of painting tools, more specifically, a device that is configured to clean off a paintbrush.

SUMMARY OF THE INVENTION

The rotating wire brush tool is an appliance that is used to clean paintbrushes. The paint uses rotating wires to extract paint from a paintbrush.

These together with additional objects, features and advantages of the rotating wire brush tool will be readily apparent to those of ordinary skill in the art upon reading the following detailed description of presently preferred, but nonetheless illustrative, embodiments of the rotating wire brush tool when taken in conjunction with the accompanying drawings.

In this respect, before explaining the current embodiments of the rotating wire brush tool in detail, it is to be understood that the rotating wire brush tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotating wire brush tool.

It is therefore important that the claims be regarded as including such equivalent construction insofar as they do not depart from the spirit and scope of the rotating wire brush tool. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
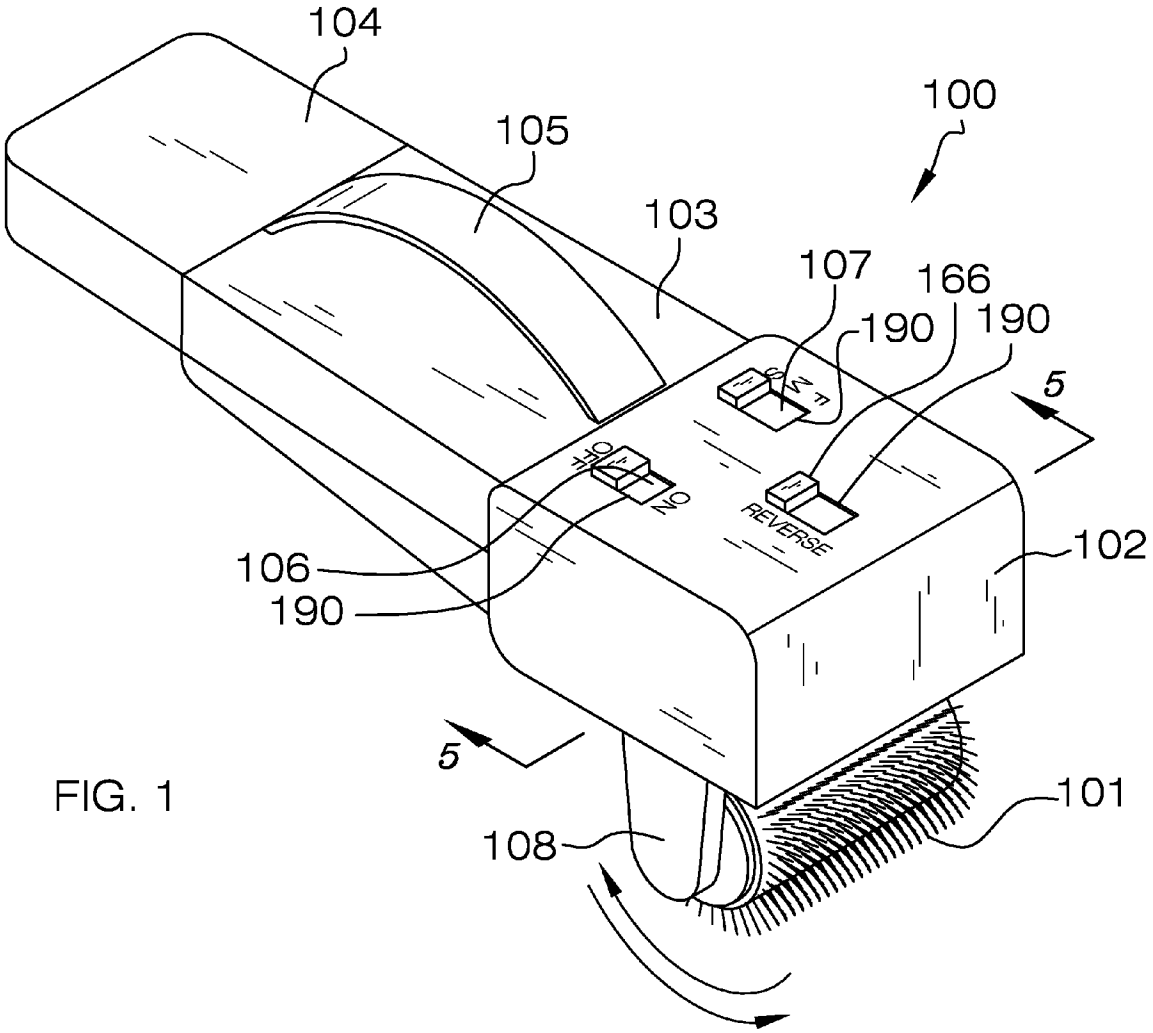
FIG. 1 is a top front perspective view of an embodiment of the disclosure.
Figure 2:
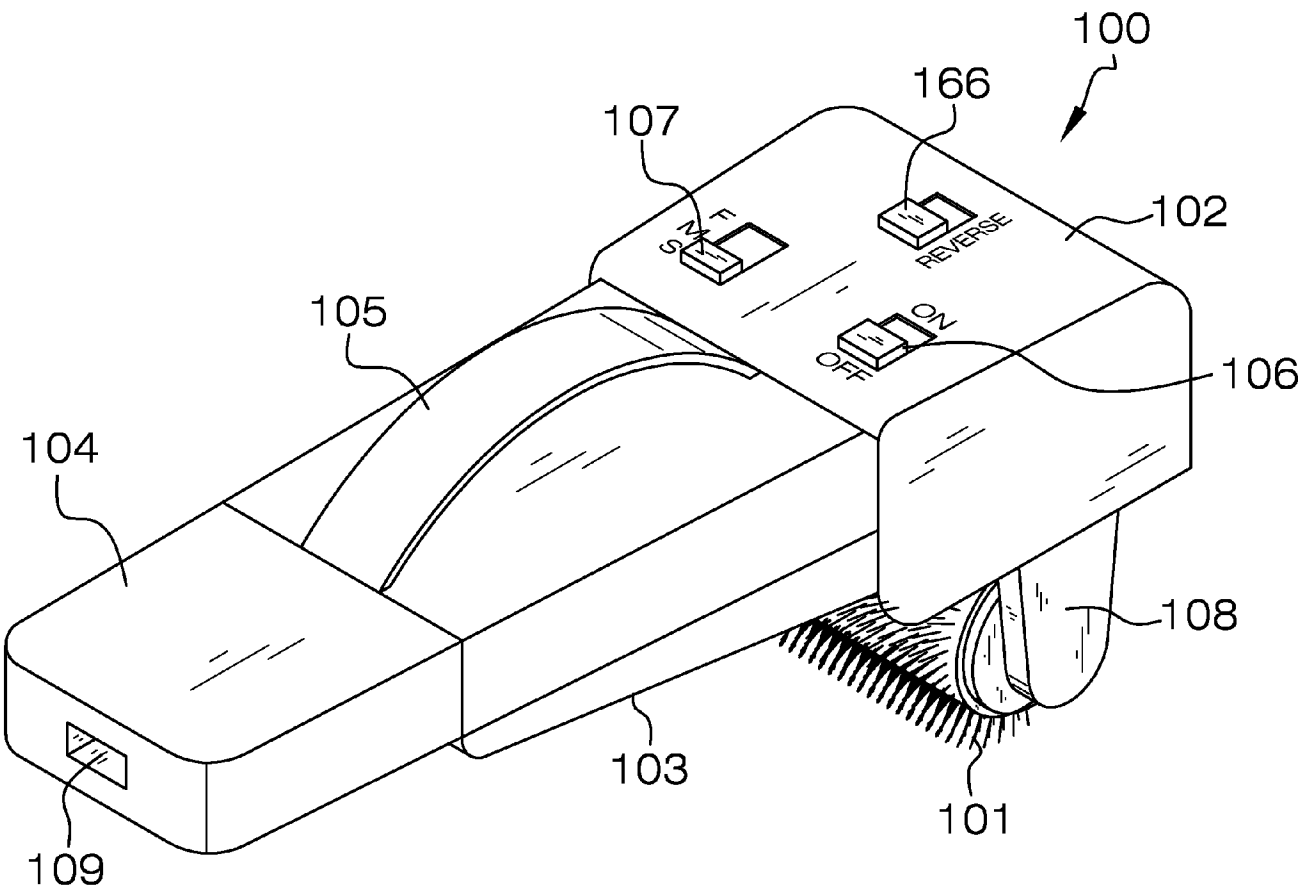
FIG. 2 is a top rear perspective view of an embodiment of the disclosure.
Figure 3:
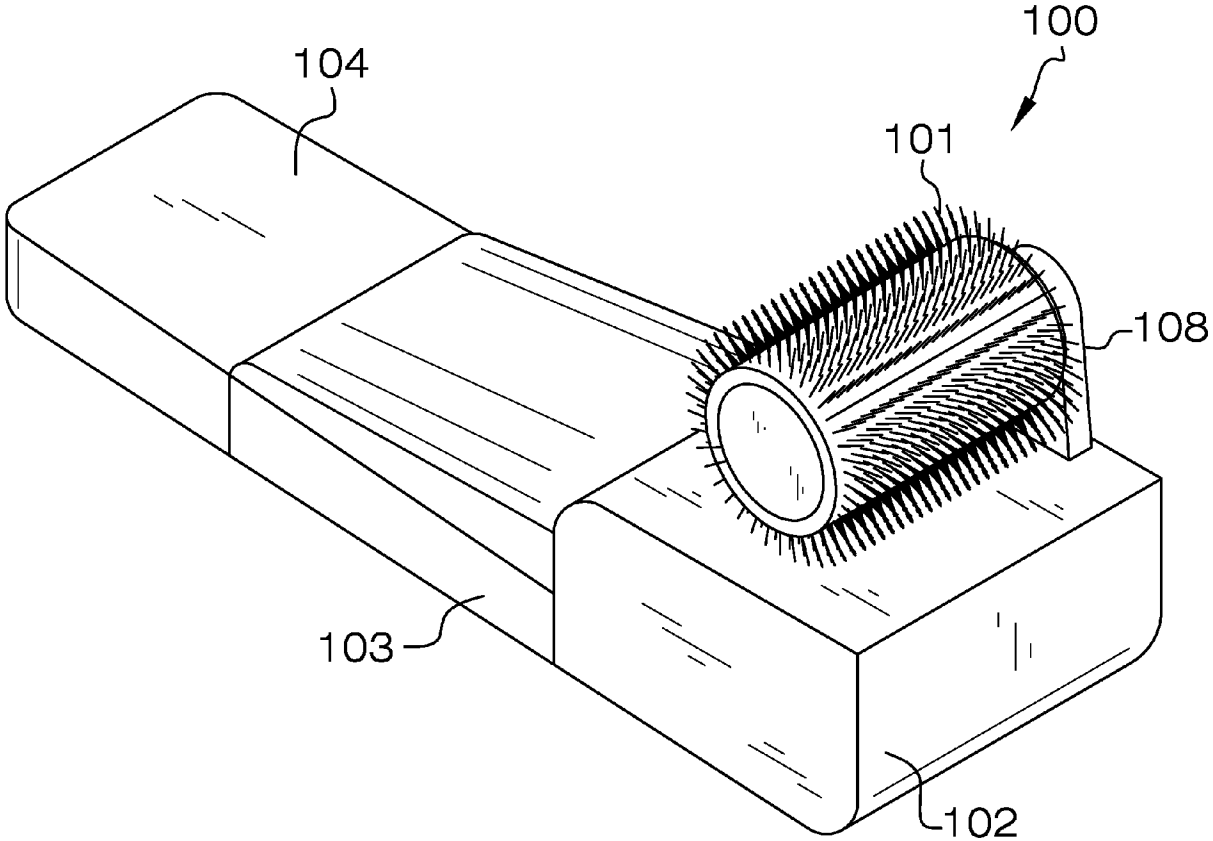
FIG. 3 is bottom front perspective view of an embodiment of the disclosure.
Figure 4:
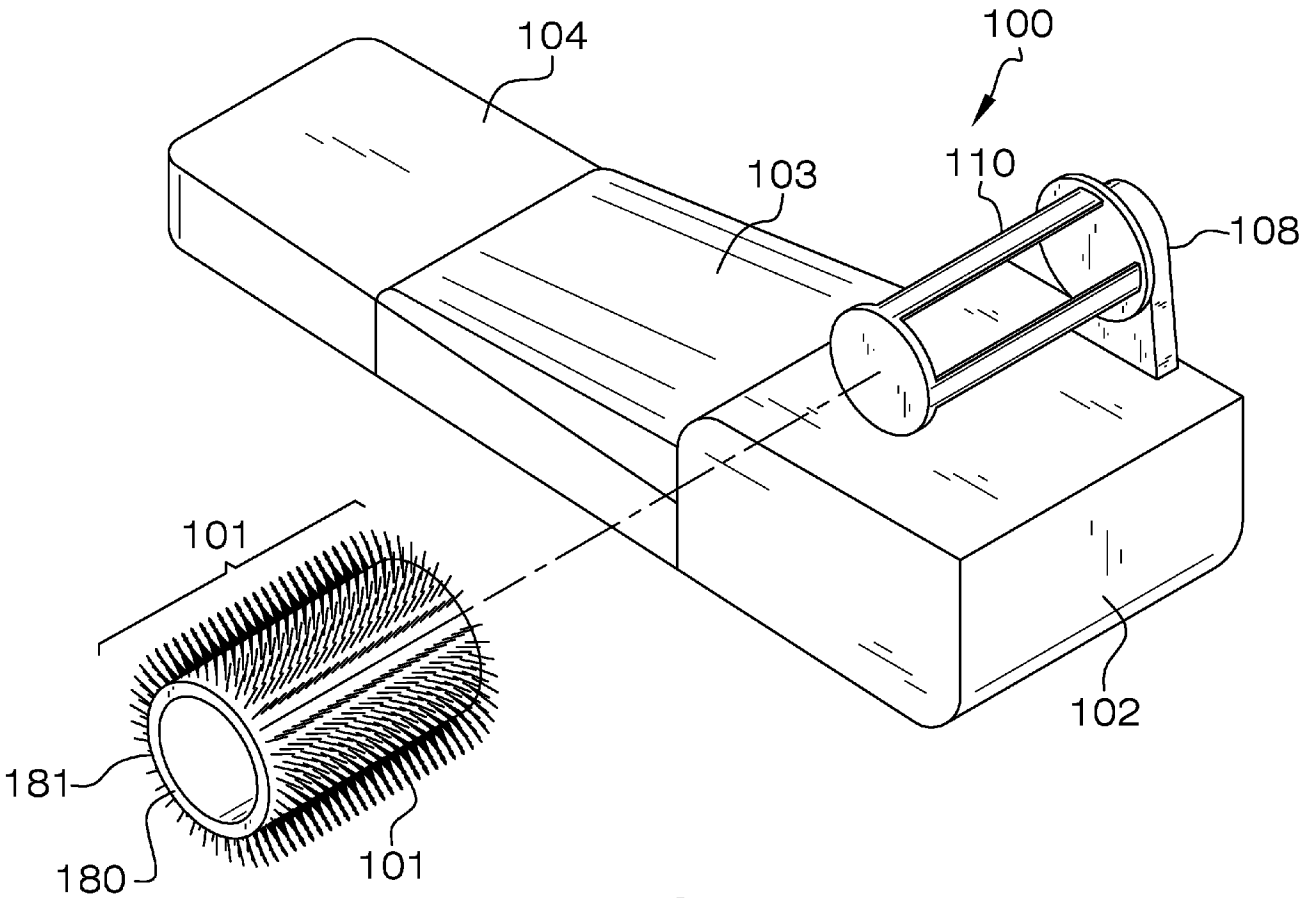
FIG. 4 is a bottom rear perspective view of an embodiment of the disclosure.
Figure 5:
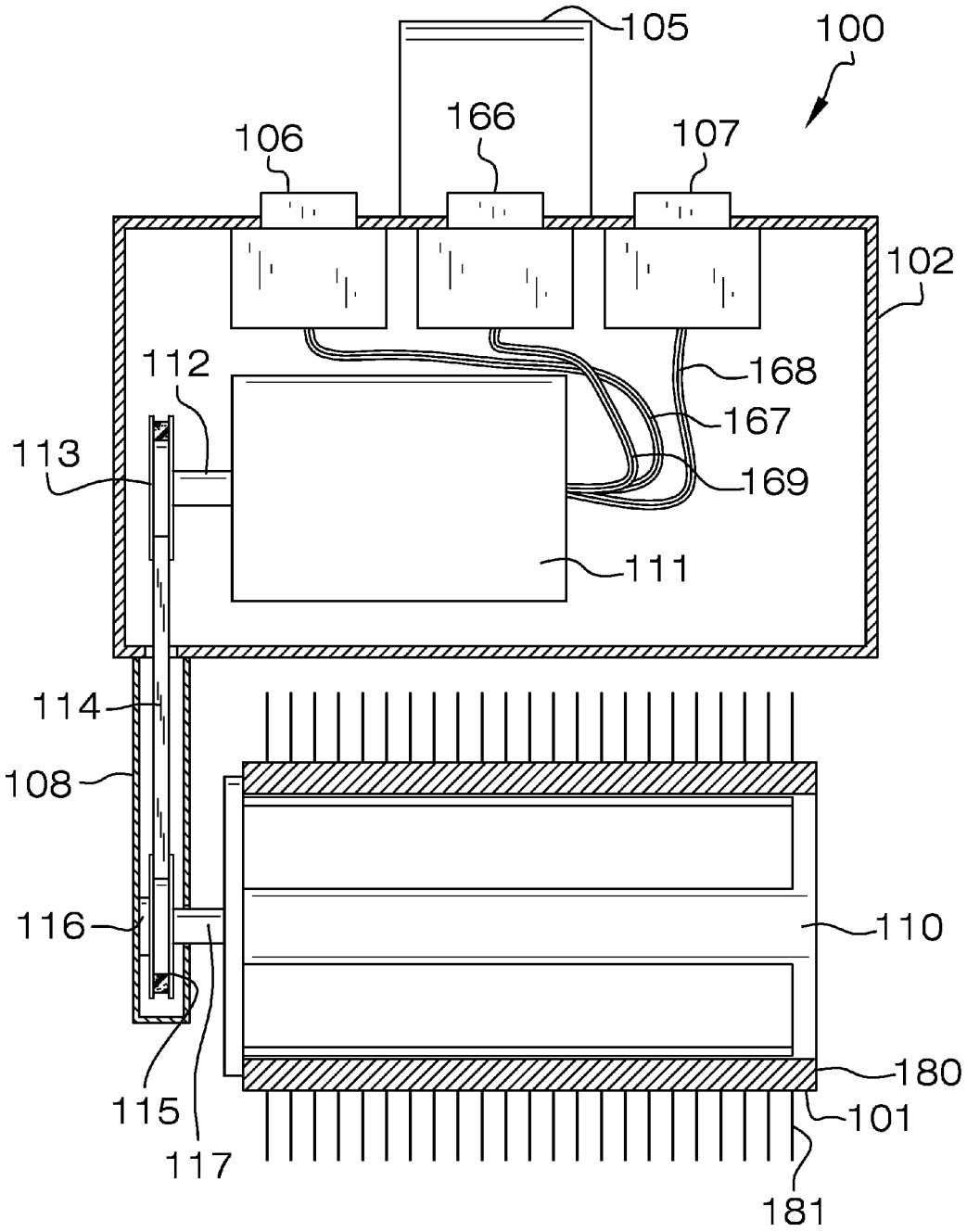
FIG. 5 is a cross-sectional view of an embodiment of the disclosure along line 5-5 in FIG. 1.
Figure 6:
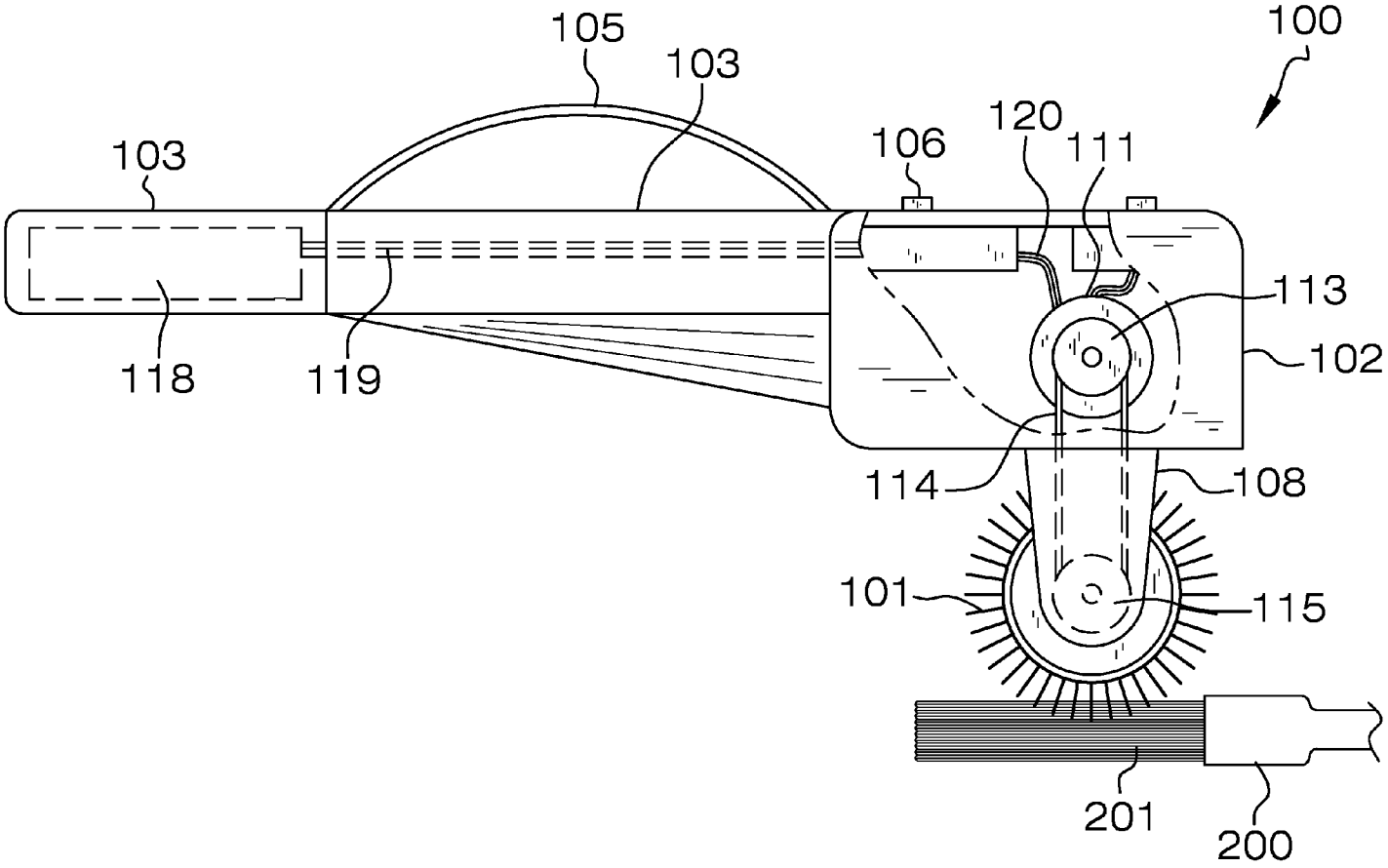
FIG. 6 is a side view of an embodiment of the disclosure.

As best illustrated in FIGS. 1 through 6, the rotating wire brush tool 100 (hereinafter invention) generally comprises a wire brush 101. The wire brush 101 is rotatable, and is configured to be used with a paintbrush 200 in order to clean paintbrush bristles 201 via the wire brush 101. The wire brush 101 is also reusable. The invention 100 includes a motor compartment 102, a power compartment 104, and a body compartment 103.

The wire brush 101 is further defined with a hollowed cylinder 180 from which a plurality of wire bristles 181 extend radially. Moreover, the wire bristles 181 extend outward from the surface of the hollowed cylinder 180. The wire brush 101 is mounted on the invention 100 by sliding the wire brush 101 on to a wire brush holder frame 110.

The wire brush holder frame 110 is permanently attached to a second shaft 117. The second shaft 117 is rotatably affixed to a second pulley 115. The second pulley 116 is mounted to a bearing 116. The second pulley 115 and bearing 116 are mounted inside of a motor belt pulley cover 108. The motor belt pulley cover 108 is attached to the motor compartment 102.

The motor compartment 102 houses a drive motor 111, a first shaft 112, a first pulley 113, a drive belt 114, a power switch 106, a speed control switch 107, and associated wiring. The drive motor 111 is in mechanical connection with and rotates the first shaft 112, which turns the first pulley 113. The drive belt 114 is mounted around the first pulley 113 and the second pulley 115. When the drive motor 111 turns the first pulley 113, the drive belt 114 transmits the rotational energy from the drive motor 111 to the second pulley 115, which then rotates the wire brush 101.

In one embodiment, the power compartment 104 houses a powering member that is generally comprised of an electrical power source 118 and the battery wires 119. The power source 118 is further defined as including at least one battery that is responsible for supplying the electrical needs of the invention 100.

The drive motor 111 is connected to the power source 118 through a power switch 106. When the power switch 106 is in the closed position, electricity flows from the power source 118 through the battery wires 119 into the power switch 106. From the power switch 106 electricity flows through a drive wire 120 into the drive motor 111, which puts the invention 100 in an operating state. When the power switch 106 is in the open position, the invention 100 is in an inoperative state.

An alternative embodiment of the invention 100 includes the speed control switch 107. The speed control switch 107 is in electrical connection between the power switch 106 and the drive motor 111. The speed control switch 107 controls the rpm of the drive motor 111, and which may simply involve a voltmeter. Optionally, a reverse switch 166 may be included. The reverse switch 166 enables the polarity of the drive motor 111 to be reversed in order to rotate the wire brush 101 in reverse. The power switch 106, the speed control switch 107, and the reverse switch 166 are mounted through switch holes 190 formed in the motor compartment 102 to allow user access to these components of the invention 100. The power switch 106, the speed control switch 107, and the reverse switch 166 are each in wired connection with the drive motor 111. Moreover, the power switch 106 connects with the drive motor 111 via a drive wire 167. The speed control switch 107 connects with the drive motor 111 via a speed wire 168. The reverse switch 166 connects with the drive motor 111 via a reverse wire 169.

The body compartment 103 provides a pathway for the battery wires 119 to run from the power source 118 to the power switch 106. The motor compartment 102 and power compartment 104 are attached to the body compartment 103 as well as a handle 105. Moreover, the body compartment 103 is positioned in between the motor compartment 102 and the power compartment 104. The handle 105 is provided for user convenience when transporting and using the invention 100.

The motor compartment 102, the power compartment 104, and the motor belt pulley cover 108 are essentially in the shape of a rectangular block. The body compartment 103 is essentially in the shape of a trapezoidal prism. The handle 105 is in the shape of a strip.

The motor belt pulley cover 108 is attached to the motor compartment 102. The power compartment 104 and the combination of the motor belt pulley cover 108 and the motor compartment 102 are attached directly to the body compartment 103. The handle 105 can be attached to the body compartment 103 or formed directly as part of the compartment. The motor belt pulley cover 108, the motor compartment 102, the power compartment 104, and the body compartment 103 can be formed from molded plastic. The drive motor 111 can be a commercially available permanent magnet motor.

The wire brush 101 can be a commercially available radial end brush, a bench wheel brush or a wire wheel brush. The wire brush holder frames 110 that match the selected wire brush 101 are commercially available and would be selected to match the selected wire brush 101.

The power system can be configured to use rechargeable or disposable batteries. When rechargeable batteries are used a connection port 109 is incorporated into the power compartment 104 to allow the battery system source access to an external power source. When disposable batteries are used an access door is incorporated into the power compartment 104 to allow for battery insertion and replacement. Alternatively, the invention can be powered directly from an external AC electricity power source. In this case, the battery system would be replaced by a transformer and an AC to DC conversion circuit. Appropriate AC and DC power circuits are well known and documented in the art and are readily available to one skilled in the art.

Commercially available switches, pulleys, bearings, shafts, and wires are used to perform the functions of the power switch 106, optional speed control switch 107, first pulley 113, second pulley 115, bearing 116, drive belt 114, and second shaft 117.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rotating wire brush tool comprising:

a brush tool that is rotatable engaged with respect to a wire brush holder frame;

said brush tool is adapted to brush bristles of a paintbrush in order to clean said paintbrush after use;

wherein the brush tool is further defined as a wire brush;

wherein the wire brush is further defined with a hollowed cylinder from which a plurality of wire bristles extend radially;

wherein the wire bristles extend outward from the surface of the hollowed cylinder;

wherein the wire brush is slideably positioned on a wire brush holder frame;

wherein the wire brush holder frame is permanently attached to a second shaft on a first end and has a free second end;

wherein the second shaft is rotatably affixed to a second pulley;

wherein the second pulley is mounted to a bearing;

wherein the second pulley and bearing are mounted inside of a motor belt pulley cover;

wherein the motor belt pulley cover is attached to a motor compartment;

wherein the motor compartment houses a drive motor, a first shaft, a first pulley, a drive belt, a power switch, a speed control switch;

wherein the drive motor is in mechanical connection with and rotates the first shaft, which turns the first pulley;

wherein the drive belt is mounted around the first pulley and the second pulley;

wherein the drive motor turns the first pulley, and the drive belt transmits the rotational energy from the drive motor to the second pulley, which then rotates the wire brush;

wherein a power compartment houses a powering member that is generally comprised of an electrical power source and a battery wire;

wherein the power source is further defined as including at least one battery that is responsible for supplying the electrical needs of the rotating wire brush tool;

wherein the drive motor is connected to the power source through a power switch; wherein the power switch is in the closed position, electricity flows from the power source through the battery wires into the power switch;

wherein from the power switch, electricity flows through a drive wire into the drive motor, which puts the drive motor in an operating state;

wherein a speed control switch is in electrical connection between the power switch and the drive motor;

wherein the speed control switch controls rotational speed of the drive motor;

wherein a reverse switch is included, and enables the polarity of the drive motor to be reversed in order to rotate the wire brush in reverse;

wherein the power switch, the speed control switch, and the reverse switch are each in wired connection with the drive motor;

wherein the power switch connects with the drive motor via a drive wire;

wherein the speed control switch connects with the drive motor via a speed wire;

wherein the reverse switch connects with the drive motor via a reverse wire;

wherein the power switch, and the speed control switch are mounted through switch holes formed in the motor compartment to allow user access;

wherein the reverse switch is mounted through one of the switch holes formed in the motor compartment to allow user access;

wherein the body compartment provides a pathway for the battery wires to run from the power source to the power switch;

wherein the motor compartment and power compartment are attached to the body compartment as well as a handle;

wherein the body compartment is positioned in between the motor compartment and the power compartment;

wherein the motor belt pulley cover is attached to the motor compartment;

wherein the power compartment and the combination of the motor belt pulley cover and the motor compartment are attached directly to the body compartment;

wherein the handle is attached to the body compartment.

* * * * *